US006496986B1

(12) United States Patent
Lumsden

(10) Patent No.: US 6,496,986 B1
(45) Date of Patent: Dec. 24, 2002

(54) TOILET BOWL VENTING DEVICE

(76) Inventor: Ray Allen Lumsden, 2839 Rome Hwy., Cedartown, GA (US) 30125

( * ) Notice: Subject to any disclaimer, the term of this patent is extended or adjusted under 35 U.S.C. 154(b) by 0 days.

(21) Appl. No.: 10/001,577

(22) Filed: Nov. 1, 2001

(51) Int. Cl.[7] ..... E03D 9/04
(52) U.S. Cl. ..... 4/213; 4/216; 4/217
(58) Field of Search ..... 4/209 R, 210, 4/211, 213–215, 216, 217

(56) References Cited

U.S. PATENT DOCUMENTS 1,861,501 A * 6/1932 Lowther ..... 4/213
3,108,289 A * 10/1963 Smith ..... 4/213
3,849,808 A * 11/1974 Olson et al. ..... 4/213
3,916,459 A * 11/1975 Ivancevic ..... 4/213
4,085,470 A * 4/1978 Roberts ..... 4/213
4,175,293 A * 11/1979 Stephens et al. ..... 4/209 R
4,375,704 A * 3/1983 Smith ..... 4/213
4,780,913 A * 11/1988 Williams ..... 4/213
5,199,111 A * 4/1993 Antepenko ..... 4/209 R
5,355,536 A * 10/1994 Prisco ..... 4/217
5,991,934 A * 11/1999 Hsu ..... 4/213

* cited by examiner

*Primary Examiner*—Gregory Huson
*Assistant Examiner*—Tuan Nguyen

(57) ABSTRACT

Disclosed is a venting device for removing unpleasant odors directly from inside the toilet bowl where most offensive odors originate. The odor is removed by means of an adjustable air intake which projects into a tubular device that attaches by means of tubing to duct work which exhaust unpleasant air via a duct fan. The exhausted air can be directed into attic, basement, crawl space areas, or may be sent directly outside by roof or side vents. Activation of exhaust fan may be by means of a typical on or off switch, motion detector or other devices.

3 Claims, 3 Drawing Sheets

TOILET BOWL VENTING DEVICE

BACKGROUND OF THE INVENTION

The present invention of the toilet bowl venting device is to provide an effective means of removing odors incurred in bathroom use.

There have been developed other devices for removing bad odor from within toilet bowl by which air is filtered or vented away from room. Each of these previous devices entailed use of many specific manufactured parts and considerable assembly process. To this cause is reason for developing a simple, less involved means to expel the unpleasant odor related to toilet use.

SUMMARY OF INVENTION

A primary objective of the present invention is to provide for the complete removal of unpleasant odors which originate inside the toilet bowl area as involved in toilet use.

Another objective of the invention is to provide a device which will allow for removal of air from inside toilet while allowing use of any type standard toilet seat and cover which may be desired for function or appearance preference.

An additional objective of invention is to provide a cover for said invention which through design can provide aesthetics qualities.

To achieve the above and the additional objects, the present invention includes a one piece adjustable air intake which can be adjusted to the precise point of maximum efficiency.

The unpleasant air is channeled through the main housing which is located between and attached to the two bolts which secure toilet seat to toilet bowl.

The main housing consists of a rectangular opening by which the adjustable air intake slides into and is secured. Other end of main housing consists of a tubular channel with like openings at both ends. A cap and vent is provided to direct vented air to either direction.

Invention is thereby connected to tubing which is attached to a duct fan located in attic area, basement or crawl space. Resulting air is then exhausted to area chosen for placement of duct fan.

Activation of duct fan motor may be provided by a variety of means but not limited to standard on and off switch or motion detector.

BRIEF DESCRIPTION OF DRAWINGS

The above and other objects of the present invention can be best understood by examining the detailed description of the preferred embodiments and accompanying drawings wherein.

DETAILED DESCRIPTION OF THE PREFERRED EMBODIMENT

Figure 1:
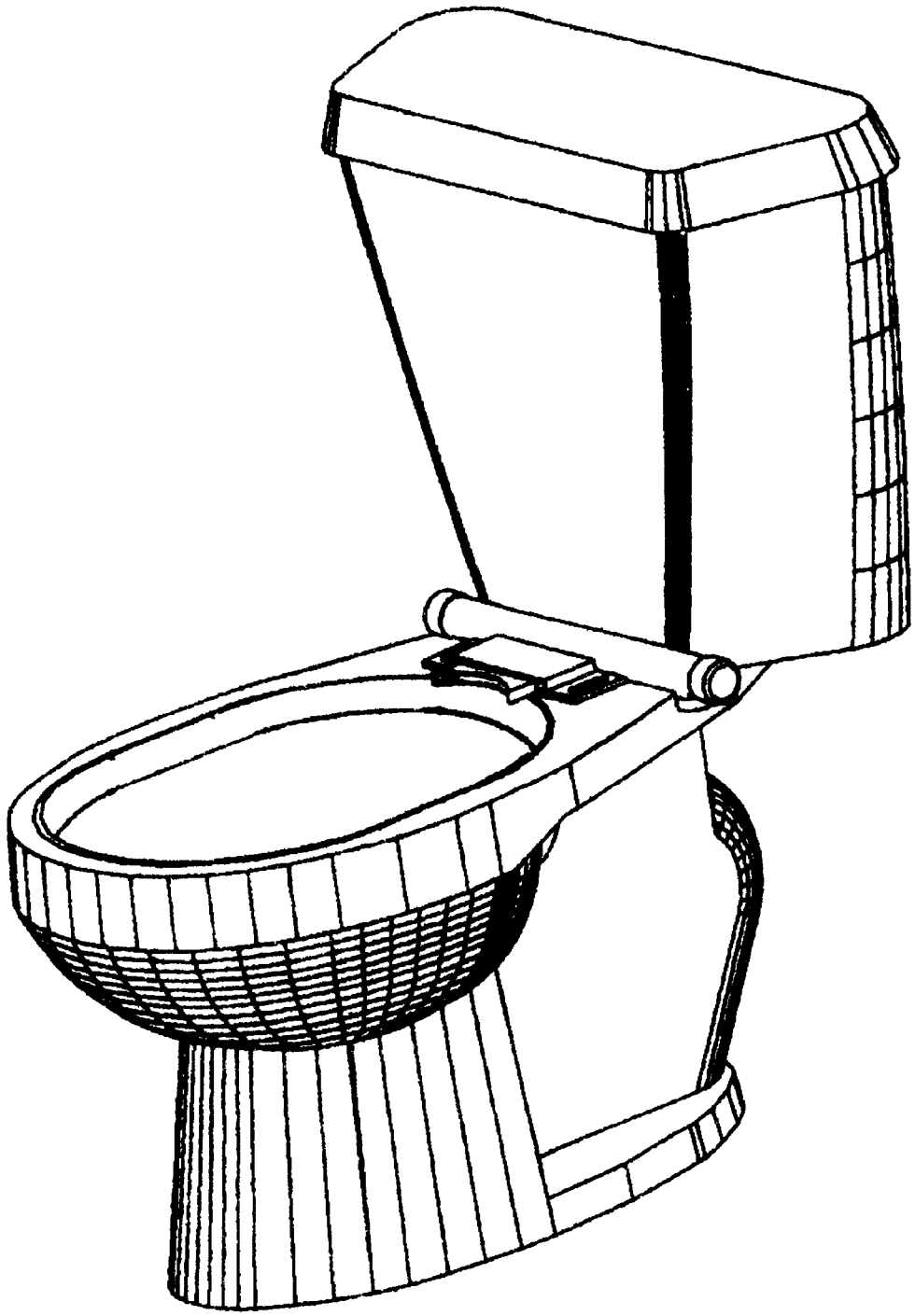
FIG. 1 depicts typical toilet having toilet bowl venting device attached (less toilet seat and cover).
Figure 2:
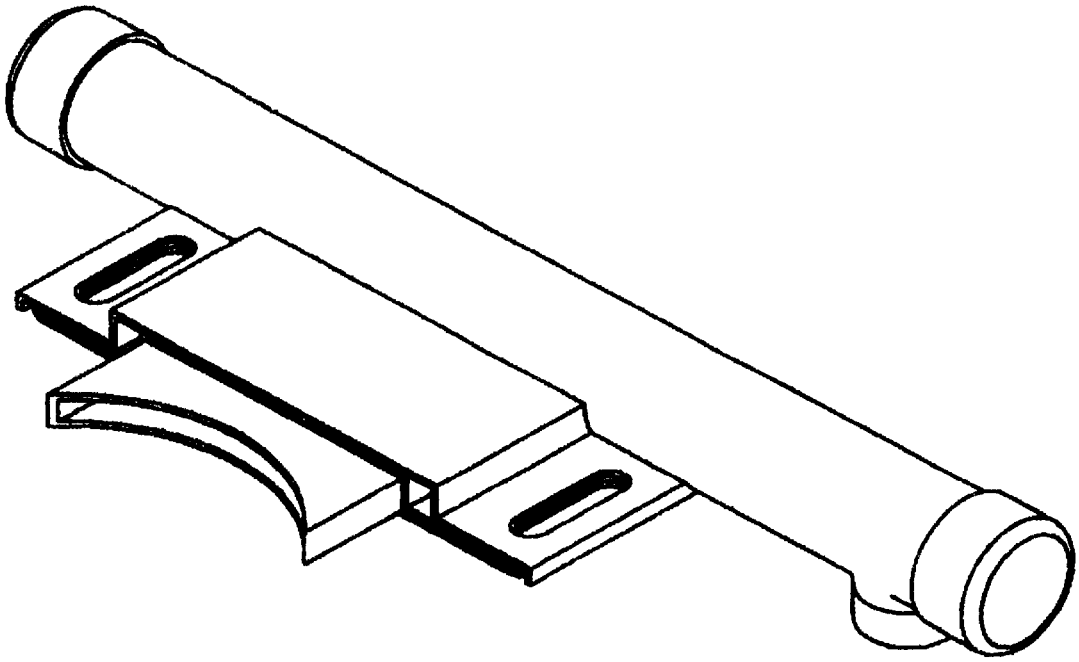
FIG. 2 is perspective view of the assembled toilet bowl venting device.
Figure 3:
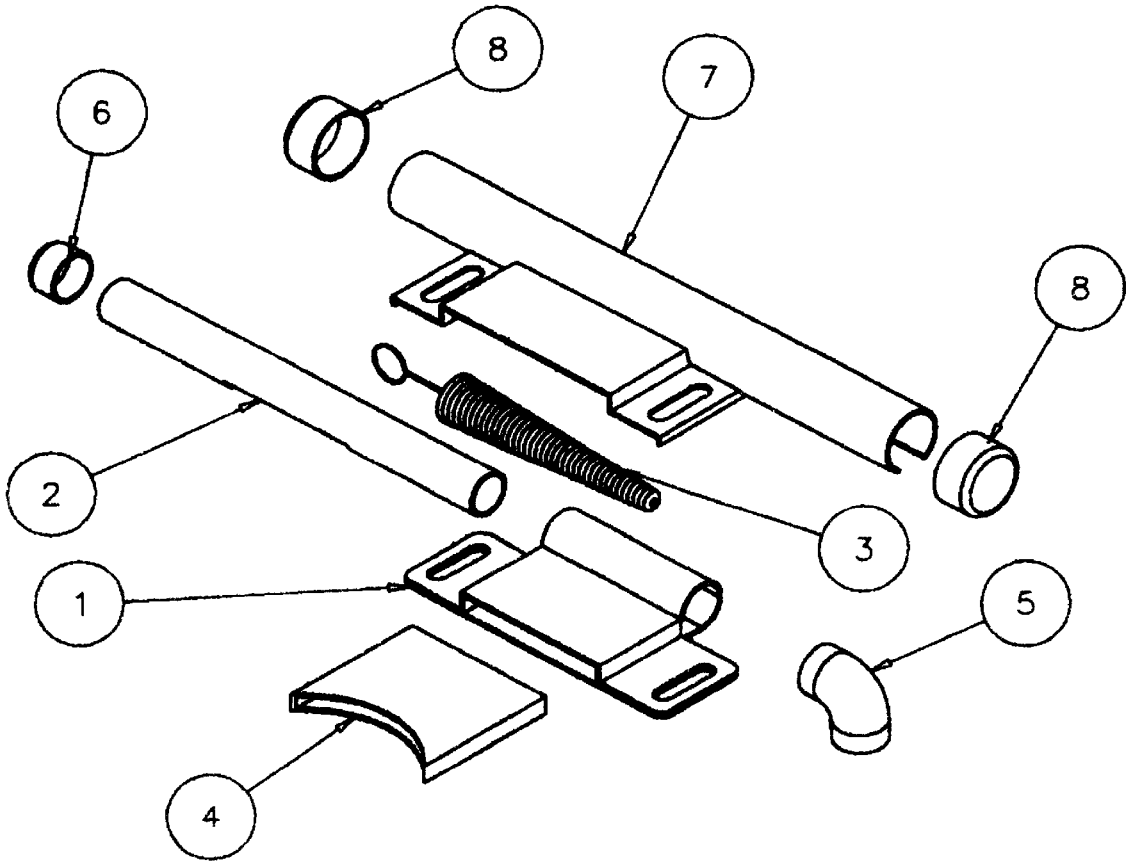
FIG. 3 is a perspective view showing each part of toilet bowl venting device unassembled and numbered.

Please refer to FIG. 3 of drawings. The present invention includes main housing 1 which attaches by means of slotted holes to existing hole found on all toilets which are used to secure the toilet seat and cover to toilet bowl. The undesirable odor from air inside the toilet bowl first enters adjustable air intake 4 upon passing through main housing 1 air is directed over and through a tapered brush 3 at which time fine particles (lint) from toilet paper is retained. Air then passes thru vent 5 where it is channeled thru other tubing or duct work (not shown in drawings) and is expelled by means of a duct fan to attic area, basement area, crawl space, or ducted directly outside via vents.

Air being removed from toilet bowl may be directed to either side of toilet bowl by switching parts 5 and 6 which are interchangeable.

Part 3 serves as previously indicated and is also intended to be used in periodic cleaning of all the various openings found in this device.

A cover 7 is provided which also have two snap on end caps 8. Cover is intended to provide enhanced aesthetics.

What is claimed is:

1. An odor removing and venting device for a toilet bowl having an exhaust unit, the device comprising:

a main housing having an internal air passage and two slotted holes for mounting the main housing to a toilet bowl via existing holes found on the toilet bowl for placement of toilet seat and cover;

a tube having first and second ends and an open slot for inserting into the main housing, wherein the open slot aligned with the air passage for exhausting unpleasant odor from within the toilet bowl thru the air passage and the open slot outward in either end of the tube by altering placement of a vent cap at one end of the tube and an end cap at the other end of the tube; and a tapered bristles brush device located inside the tube for filtering out particles from toilet paper passing thru the air passage into the brush bristles so that to enable the odor removing and venting device to function more efficiently, wherein the tapered brush can be removed to function as a cleaning device.

2. The odor removing and venting device as claimed in claim 1, wherein a one-piece adjustable air intake having an air inlet and being slidably extend inward or outward from the air passage of the main housing for adjusting the location of the air inlet to allow maximum efficiency.

3. The odor removing and venting device as claimed in claim 1, wherein the device further comprises a one-piece cover for covering the tube and main housing, the cover having two slotted holes at a base which align with the slotted holes of the main housing and the existing holes found on the toilet bowl, the cover includes end caps for securing the cover to the tube.

* * * * *